US011217955B1

(12) United States Patent
Ho et al.

(10) Patent No.: US 11,217,955 B1
(45) Date of Patent: Jan. 4, 2022

(54) METHOD FOR MANUFACTURING ELECTRICAL CONNECTOR

(71) Applicant: LOTES CO., LTD, Keelung (TW)

(72) Inventors: Chien Chih Ho, Keelung (TW); Wen Chang Chang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/184,898

(22) Filed: Feb. 25, 2021

(30) Foreign Application Priority Data

Dec. 18, 2020 (CN) ..... 202011510996.2

(51) Int. Cl.
*H01R 43/16* (2006.01)
*H01R 43/24* (2006.01)

(52) U.S. Cl.
CPC ..... *H01R 43/16* (2013.01); *H01R 43/24* (2013.01)

(58) Field of Classification Search
CPC ..... H01R 43/16; H01R 43/24; H01R 13/03; Y10T 29/49158; Y10T 29/49204; Y10T 29/4922
USPC ..... 29/847, 848, 874, 883
See application file for complete search history.

(56) References Cited

U.S. PATENT DOCUMENTS 4,635,359 A * 1/1987 Nozick ..... H01R 43/24 29/878
5,462,440 A * 10/1995 Rothenberger ..... H01R 43/24 439/66
6,146,151 A * 11/2000 Li ..... H01R 13/2414 439/66
6,204,065 B1 * 3/2001 Ochiai ..... H01R 13/03 436/66

FOREIGN PATENT DOCUMENTS

CN 2409632 Y 12/2000
CN 1082265 C 4/2002

* cited by examiner

*Primary Examiner* — Donghai D Nguyen
(74) *Attorney, Agent, or Firm* — Locke Lord LLP; Tim Tingkang Xia, Esq.

(57) ABSTRACT

A method for manufacturing an electrical connector is provided. A metal plate is provided, and defines multiple terminals. Each terminal has a base portion and an elastic arm connected to the base portion. A portion of a lower surface of the base portion defines a conducting area. The base portion is cut on the metal plate, thereby forming a cutting slot on the metal plate located at a side edge of the base portion. An insulating body is formed on the metal plate by injection molding, such that the insulating body fills the cutting slot. The insulating body covers only the base portion and not the conducting area and the elastic arm, thereby forming a through hole on the insulating body to expose the elastic arm. Then, the elastic arm is cut on the metal plate, thereby forming a through slot on the metal plate surrounding the elastic arm.

11 Claims, 10 Drawing Sheets

3'

METHOD FOR MANUFACTURING ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN202011510996.2 filed in China on Dec. 18, 2020. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to a method for manufacturing an electrical connector, and particularly to method for manufacturing an electrical connector in which the terminals are arranged densely.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An electrical connector includes an insulating body and a plurality of terminals accommodated in the insulating body. Each terminal has a fixing portion used to be fixed to the insulating body; an elastic arm formed by bending upward and extending from the fixing portion, and used to upward elastically abut a mating component, where the insulating body is provided with a through hole to expose the elastic arm; and a soldering portion formed by bending downward and extending from the fixing portion, where the soldering portion is exposed in the insulating body and is used to be soldered to a circuit board. A method for manufacturing the electrical connector includes: firstly, providing a metal plate, and cutting the elastic arm, the fixing portion and the soldering portion of each terminal on the metal plate, such that the metal plate has a through slot surrounding the elastic arm; next, providing a mold, where an upper positioning post and a lower positioning post vertically clamp the elastic arm and cover the through slot, and then injecting a plastic material to the metal plate, thereby forming an insulating body to wrap the metal plate; and then, bending upward the elastic arm, such that the elastic arm protrudes out of the insulating body. However, due to the accuracy being limited, the upper and lower positioning posts may slightly deviate vertically, causing the through slot not to be covered by the positioning posts, thereby allowing the molten plastic material to enter the through slot (which is the molten plastic overflowing). The plastic material, after being solidified, may fix the elastic arm, such that the elastic arm does not easily bend upward, and the elastic characteristics of the elastic arm become worse, causing ill contact between the elastic arm and the mating component. To prevent the molten plastic from overflowing when injecting the plastic material to the metal plate, the positioning posts may pass beyond the through slot with a greater distance along a horizontal direction, thereby causing the through hole to become larger, such that a pitch between the terminals becomes larger, which is not conducive to dense arrangement of the terminals.

Therefore, a heretofore unaddressed need to design a novel method for manufacturing the electrical connector exists in the art to address the aforementioned deficiencies and inadequacies.

SUMMARY

In view of the deficiency of the background, the present invention is directed to a method for manufacturing an electrical connector, which prevents molten plastic from overflowing and allows the terminals to be arranged densely, thereby enhance the effective contact between the terminals and a mating component.

To achieve the foregoing objective, the present invention adopts the following technical solutions.

A method for manufacturing an electrical connector is provide. The method includes: providing a metal plate in a flat plate shape, wherein the metal plate defines a plurality of terminals in a selected area, each of the terminals has a base portion and an elastic arm connected to the base portion, the elastic arm is configured to be in contact with a mating component, and a portion of a lower surface of the base portion defines a conducting area configured to be conductively connected to a circuit board; and cutting the base portion on the metal plate according to a predetermined contour of the base portion, thereby forming a cutting slot on the metal plate located at a side edge of the base portion; after cutting the base portion, forming an insulating body on the metal plate by injection molding, such that the insulating body fills the cutting slot, wherein the insulating body covers the base portion but does not cover the conducting area, and the insulating body does not cover the elastic arm, thereby forming a through hole on the insulating body to expose the elastic arm; and after forming the insulating body, cutting the elastic arm on the metal plate according to a predetermined contour of the elastic arm, thereby forming a through slot on the metal plate surrounding the elastic arm.

In certain embodiments, the insulating body forms an accommodating slot to expose the conducting area, a lower end of the accommodating slot is lower than the conducting area, along an upward direction from a bottom thereof, the accommodating slot gradually becomes smaller, and the insulating body is provided with a stopping block located between the accommodating slot and the through hole, such that the accommodating slot and the through hole are not in communication.

In certain embodiments, the method further includes: prior to forming the insulating body, forming a plurality of positioning holes on the metal plate, wherein after forming the insulating body, the insulating body does not fill the positioning holes, such that portions of the metal plate surrounding the positioning holes are exposed by the insulating body.

In certain embodiments, after forming the insulating body, the insulating body does not cover at least one outer edge of the metal plate, such that the at least one outer edge of the metal plate is exposed by the insulating body.

In certain embodiments, after forming the insulating body, the cutting slot is partially exposed in the through hole.

In certain embodiments, the method further includes: after cutting the base portion and prior to forming the insulating body, bending the conducting area downward.

In certain embodiments, the terminals include a plurality of signal terminals and a plurality of ground terminals, and after cutting the elastic arm, each of the ground terminals forms a connecting portion between the corresponding through slot and the cutting slot, wherein the connecting portion is connected to the elastic arm.

In certain embodiments, after cutting the elastic arm, a connecting portion of each of the terminals is formed between the corresponding through slot and the cutting slot and is connected to the elastic arm of each of the terminals, and after cutting the elastic arm, the connecting portion of each of the signal terminals is removed, and the connecting portion of each of the ground terminals is reserved.

In certain embodiments, the method further includes: after removing the connecting portion of each of the signal terminals, bending the elastic arm of each of the terminals upward, such that the elastic arm protrudes out of the insulating body.

In certain embodiments, the method further includes: after cutting the elastic arm and prior to removing the connecting portion of each of the signal terminals, electroplating the metal plate.

In certain embodiments, after cutting the elastic arm, the elastic arm is cut along a location spaced apart from an edge of the through hole by a distance, thereby staggering the edge of the through hole and the through slot.

Compared with the related art, certain embodiments of the present invention has the following beneficial effects. By firstly injection molding the insulating body and the metal plate, and then cutting the elastic arm on the metal plate, the through slot is formed after the injection molding, thereby not causing the plastic material to enter the through slot and fix the elastic arm, ensuring the elastic characteristics of the elastic arm, and preventing from the ill contact between the elastic arm and the mating component. Further, since there is no molten plastic overflow, the positioning posts of the mold do not need to pass beyond the through slot with a greater distance along the horizontal direction, thereby reducing the pitch between the terminals, which is conducive to the dense arrangement of the terminals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
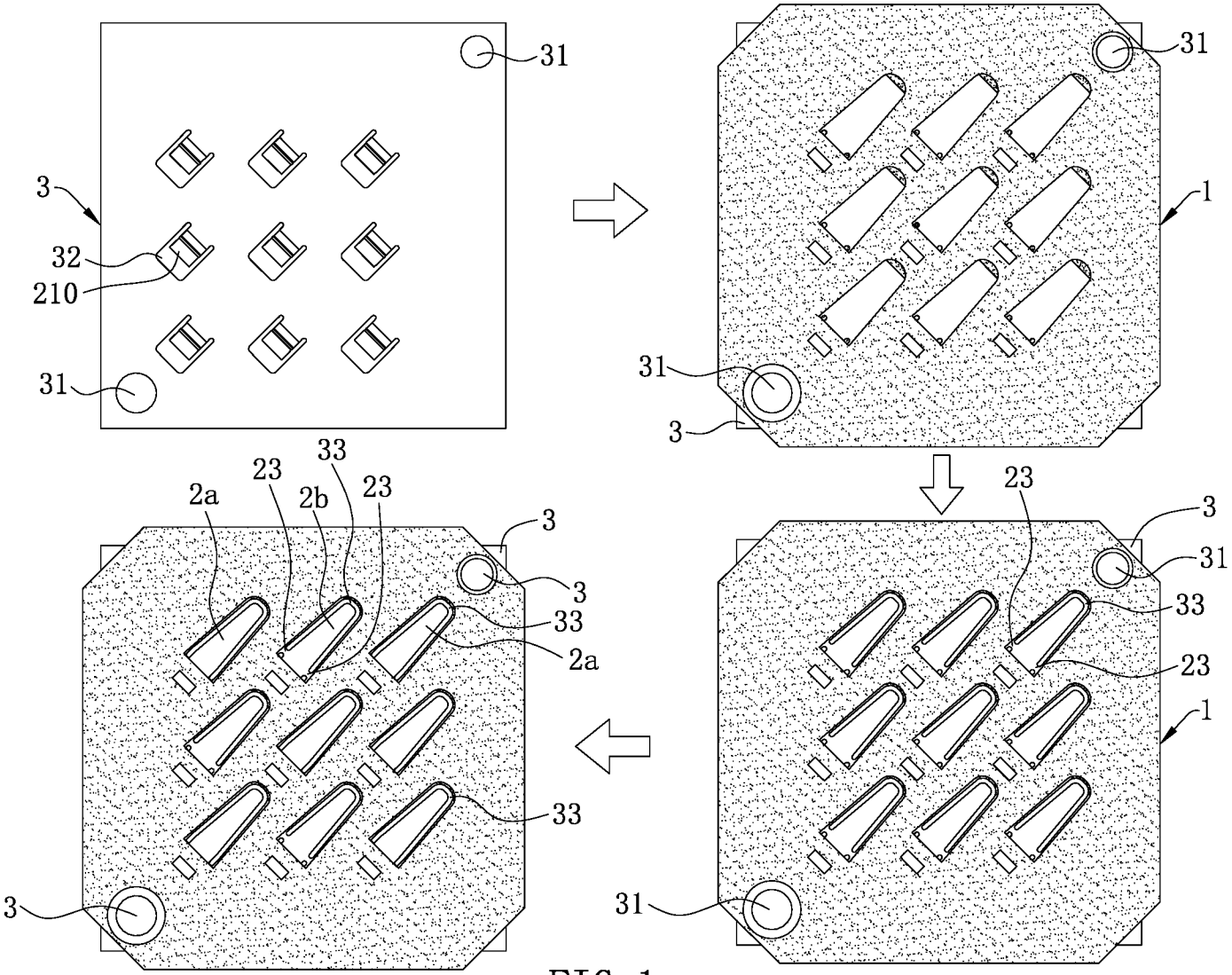
FIG. 1 is a flow top view of a method for manufacturing an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-10. In accordance with the purposes of this invention, as embodied and broadly described herein, this invention, in one aspect, relates to a method for manufacturing an electrical connector.

FIG. 1 to FIG. 5 show a method for manufacturing an electrical connector according to a first embodiment of the present invention. The electrical connector includes an insulating body 1 and a plurality of terminals 2 accommodated in the insulating body 1. The terminals 2 include a plurality of signal terminals 2*a* and a plurality of ground terminals 2*b*. Each terminal 2 has a base portion 21, used to be fixed to the insulating body 1; and an elastic arm 22 formed by bending upward and extending from the base portion 21, used to upward elastically abut a mating component M. The insulating body 1 is provided with a plurality of through holes 11 to respectively correspondingly expose the elastic arms 22 of the terminals 2. A portion of a lower surface of the base portion 21 has a conducting area 210. The conducting area 210 is exposed in the insulating body 1 and is used to be conductively connected to a circuit board N. In this embodiment, the conducting area 210 is soldered to the circuit board N through a solder. In other embodiment, the conducting area 210 may elastically abut the circuit board N, or may be conductively connected to the circuit board N through other methods. The method for manufacturing the electrical connector according to this embodiment includes the following steps:

Step 1: referring to FIG. 1, providing a metal plate 3, and cutting two positioning holes 31 at the opposite corners of the metal plate 3. In other embodiments, it may be cutting a plurality of positioning holes 31 at equal distances at the two opposite sides of the metal plate 3. Each positioning hole 31 is circular. Providing a mold (not shown, same below). The mold is provided with a plurality of pairs of fixing posts (not shown, same below) and a plurality of pairs of positioning posts (not shown, same below). The positioning holes 31 match with the pairs of fixing posts of the mold for fixing the metal plate 3. After fixing the metal plate 3 with the positioning holes 31, cutting the metal plate 3 through a laser according to a predetermined contour of the base portion 21 (when cutting the base portion 21 on the metal plate 3, the positioning holes 31 function to position the metal plate 3), thereby forming a cutting slot 32 on the metal plate 3 located at a side edge of the base portion 21. The cutting slot 32 is U-shaped. After the cutting of the base portion 21 is complete, bending the conducting area 210 downward.

Step 2: referring to FIG. 1, a diameter of each positioning hole 31 is less than that of each fixing post. Each positioning hole 31 is clamped by a pair of the fixing posts vertically. In other embodiments, it may be that some of the positioning holes 31 are clamped by the mold and some other positioning holes 31 are not clamped by the mold. Each elastic arm 22 is clamped by a pair of the positioning posts vertically. The length and width of each elastic arm 22 is less than those of each positioning post. The positioning posts, when clamping the elastic arm 22, also cover a portion of the cutting slot 32. Then, the plastic material is injected to the metal plate 3, thereby forming the insulating body 1 on the metal plate 3. The insulating body 1 covers the metal plate 3, and the insulating body 1 forms the through holes 11. Each elastic arm 22 is exposed in a corresponding through hole 11, and a length and a width of the corresponding through hole 11 is greater than a length and a width of each elastic arm 22. A portion of the cutting slot 32 is exposed in the corresponding through hole 11. The insulating body 1 does not fill the positioning holes 31, such that the portions of the metal plate 3 surrounding the positioning holes 31 are exposed in the insulating body 1. Further, at least one outer edge of the metal plate 3 is exposed out of the insulating body 1. In other embodiments, the outer edge of the metal plate 3 may be unexposed. In this embodiment, the four corners of the metal plate 3 are exposed out of the insulating body 1 (and in other embodiments, it may be that the other outer edges of the metal plate 3 are exposed out of the insulating body 1), allowing the metal plate 3 to be connected to electrodes to electroplate the metal plate 3 in the subsequent step.

Step 3: referring to FIG. 1, through the laser, cutting each elastic arm 22 along a location separated from an edge of the corresponding through hole 11. After cutting, the side edge of each elastic arm 22 forms a through slot 33 surrounding the elastic arm 22. The edge of the corresponding through hole 11 is separated from the through slot 33 (and in other embodiments, it may be cutting each elastic arm 22 along the edge of the corresponding through hole 11, such that the edge of the corresponding through hole 11 aligns with the edge of the through slot 33), thus preventing from burning the edge of the corresponding through hole 11 in the laser cutting process due to the excessively high temperature of the laser. During the laser cutting, a portion of the metal plate 3 is reserved between the through slot 33 and the cutting slot 32, such that the through slot 33 and the cutting slot 32 are not in communication, and a connecting portion 23 connected to the elastic arm 22 is formed between each through slot 33 and the corresponding cutting slot 32. In other embodiments, when cutting the elastic arm 22 of each signal terminal 2*a*, the connecting portion 23 of each signal terminal 2*a* may be simultaneously removed. After cutting the elastic arm 22, the metal plate 3 exposed out of the outer edge of the insulating body 1 is connected to the electrodes to electroplate the metal plate 3.

Step 4: referring to FIG. 1, after electroplating the metal plate 3, removing the connecting portion 23 of each signal terminal 2*a*. In other embodiments, it may be removing the connecting portion 23 of each signal terminal 2*a* and then electroplating the metal plate 3. The cutting slot 32 and the through slot 33 are in communication, such that each signal terminal 2*a* is independent from the metal plate 3. The connecting portion 23 of each ground terminal 2*b* is not removed and is thus reserved. In other embodiments, it may be removing the connecting portion 23 of each ground terminal 2*b*.

Figure 2:
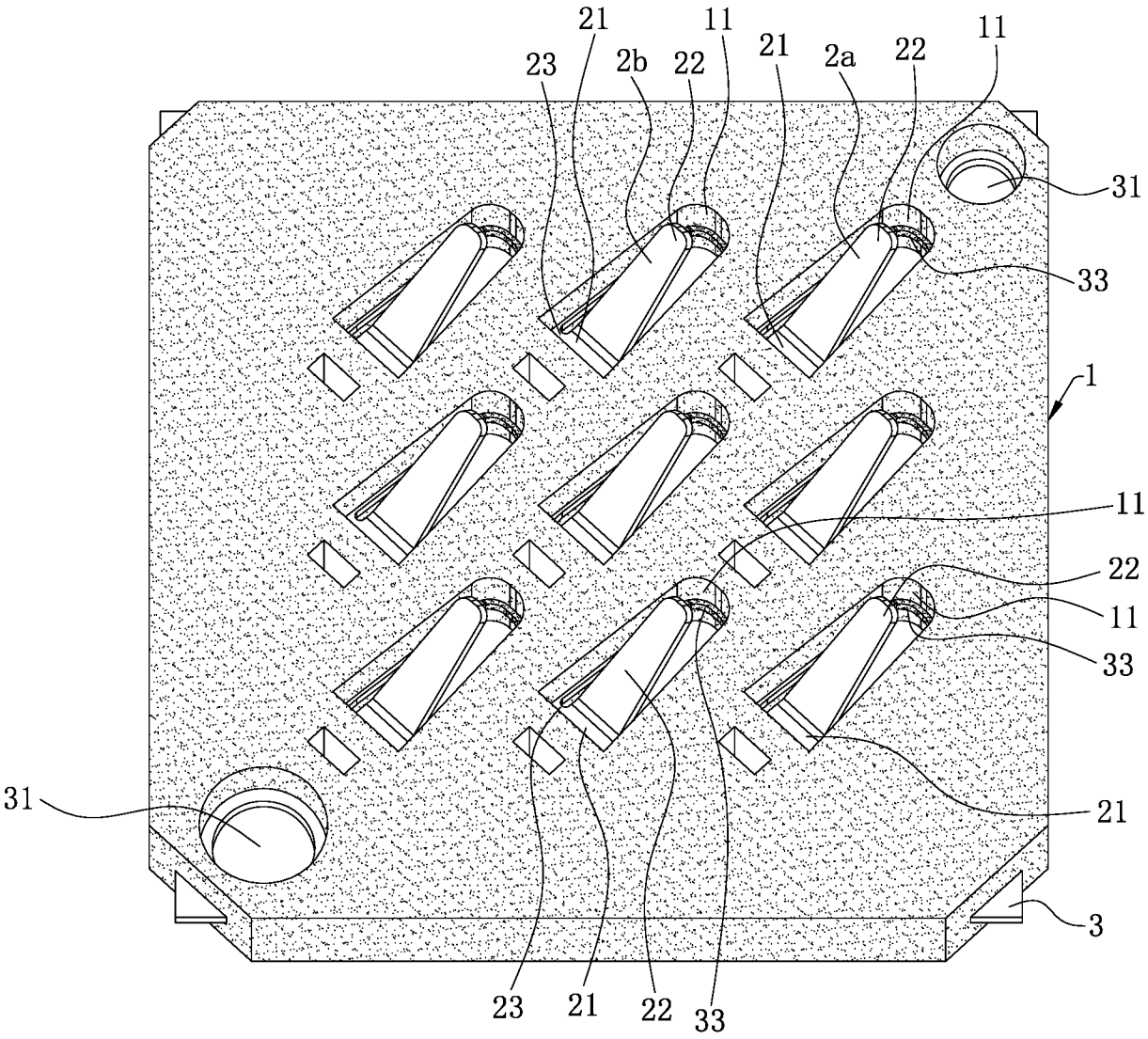
FIG. 2 is a perspective view of the electrical connector according to the first embodiment of the present invention after the elastic arm of each terminal bends upward.
Figure 3:
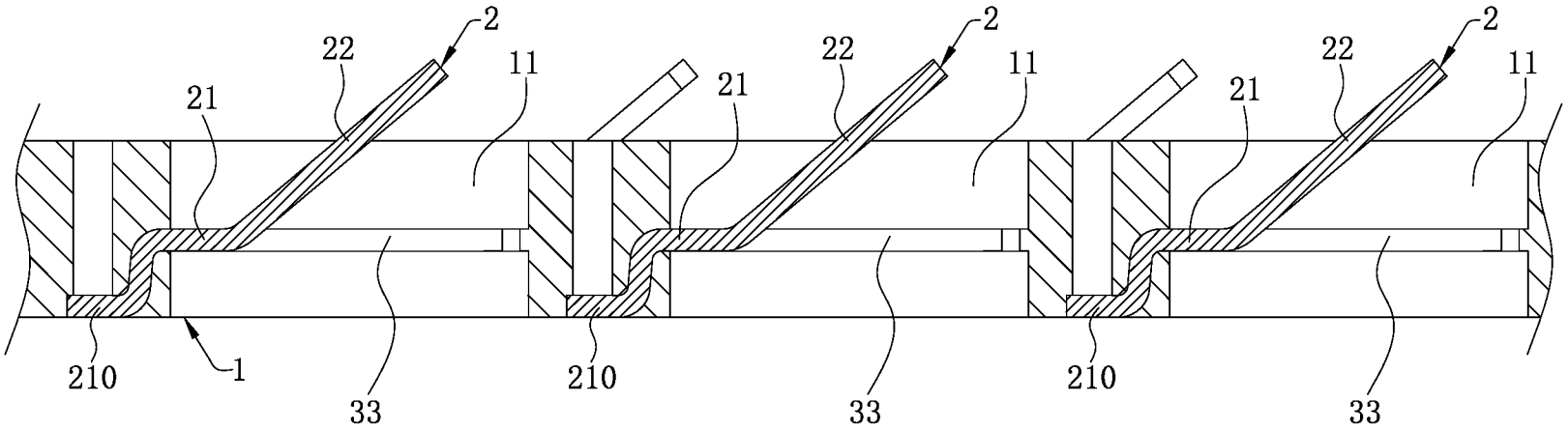
FIG. 3 is a sectional view of FIG. 2.
Figure 4:
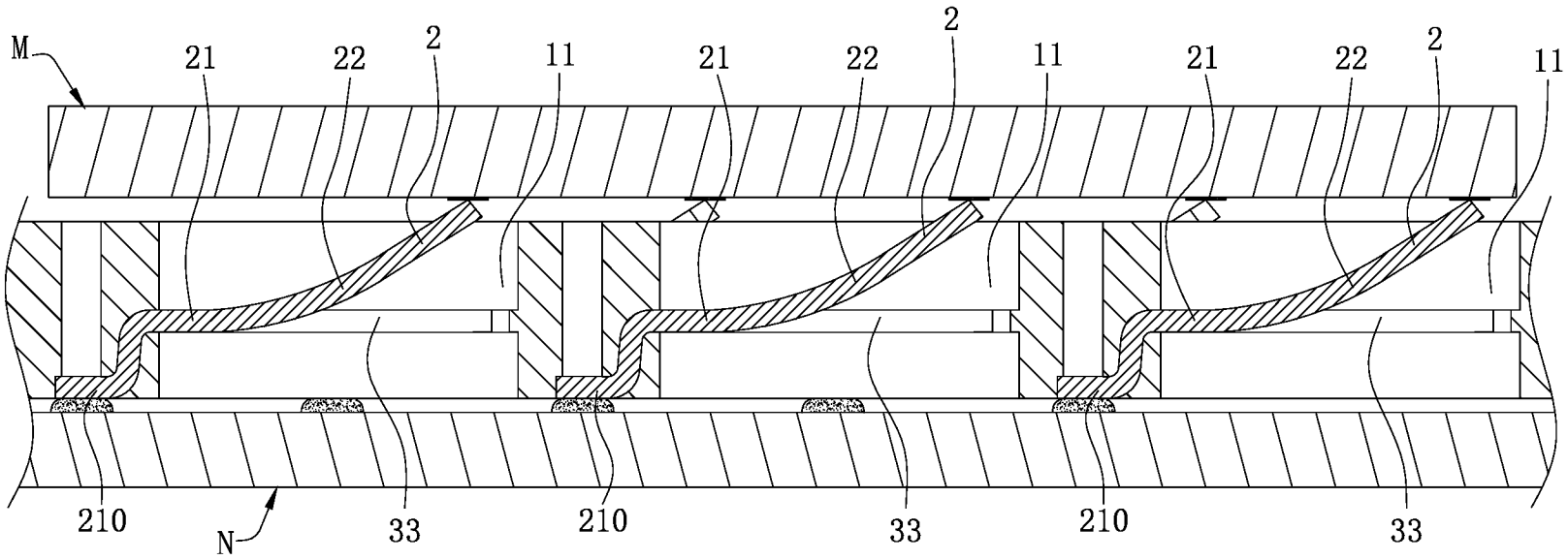
FIG. 4 is a sectional view of FIG. 3 being connected to the mating component and the circuit board.
Figure 5:
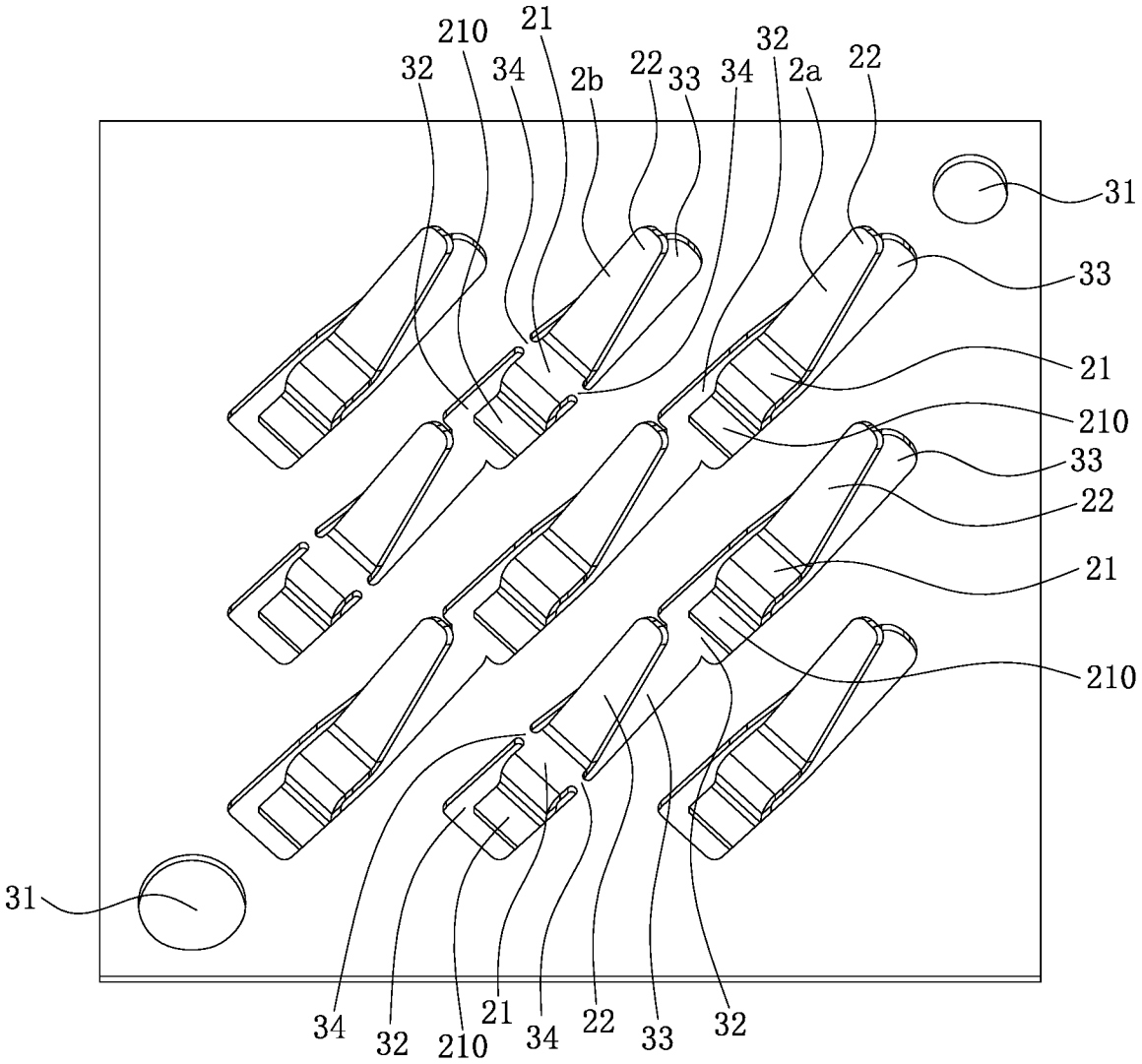
FIG. 5 is a perspective view of the metal plate in FIG. 2 after the manufacturing of the electrical connector is complete.

Step 5: referring to FIG. 2, after cutting the connecting portion 23 of each signal terminal 2*a*, bending the elastic arm 22 of each terminal 2 upward (and in other embodiments, it may be firstly bending the elastic arm 22 upward, and then cutting the connecting portion 23 of each signal terminal 2*a*), such that the elastic arm 22 protrudes upward out of the insulating body 1. By bending the elastic arm 22 of each signal terminal 2*a* upward after cutting the connecting portion 23 of each signal terminal 2*a*, it is conducive to laser focusing in the cutting process, such that the cutting location is more accurate.

Figure 6:
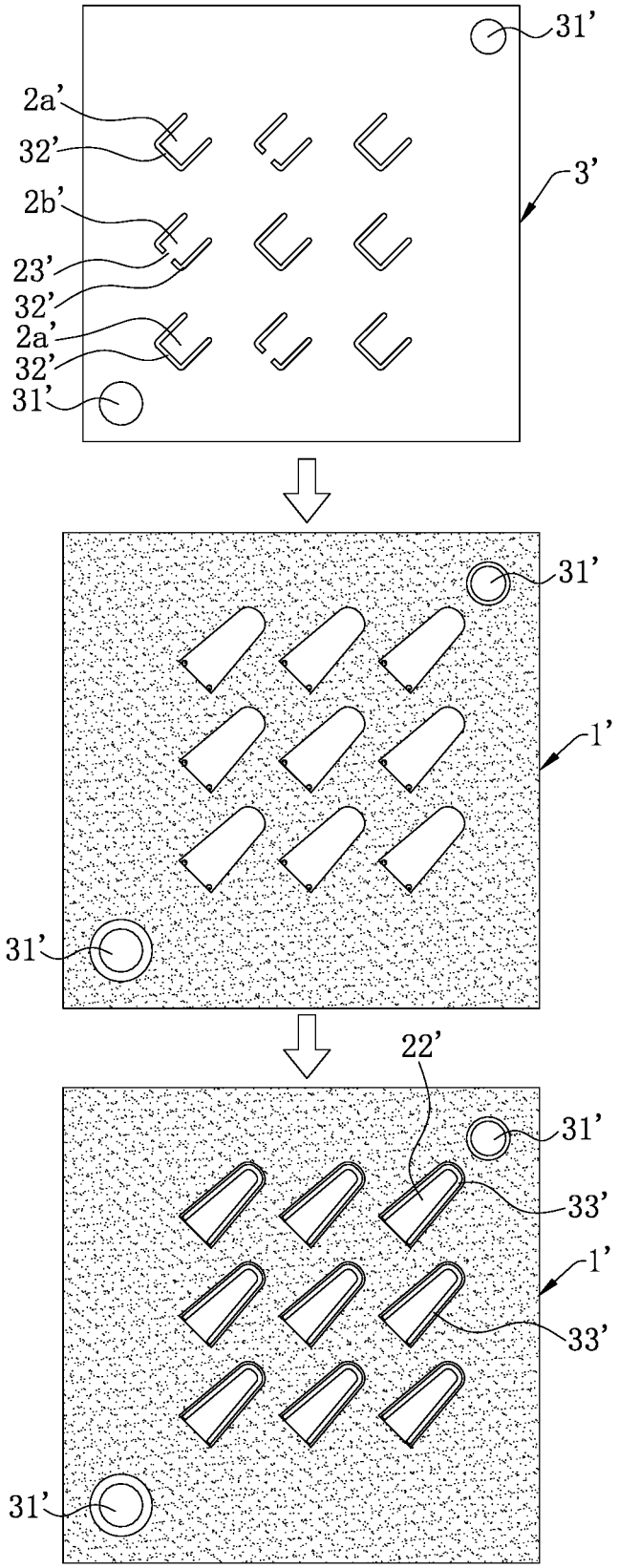
FIG. 6 is a flow top view of a method for manufacturing an electrical connector according to a second embodiment of the present invention.
Figure 7:
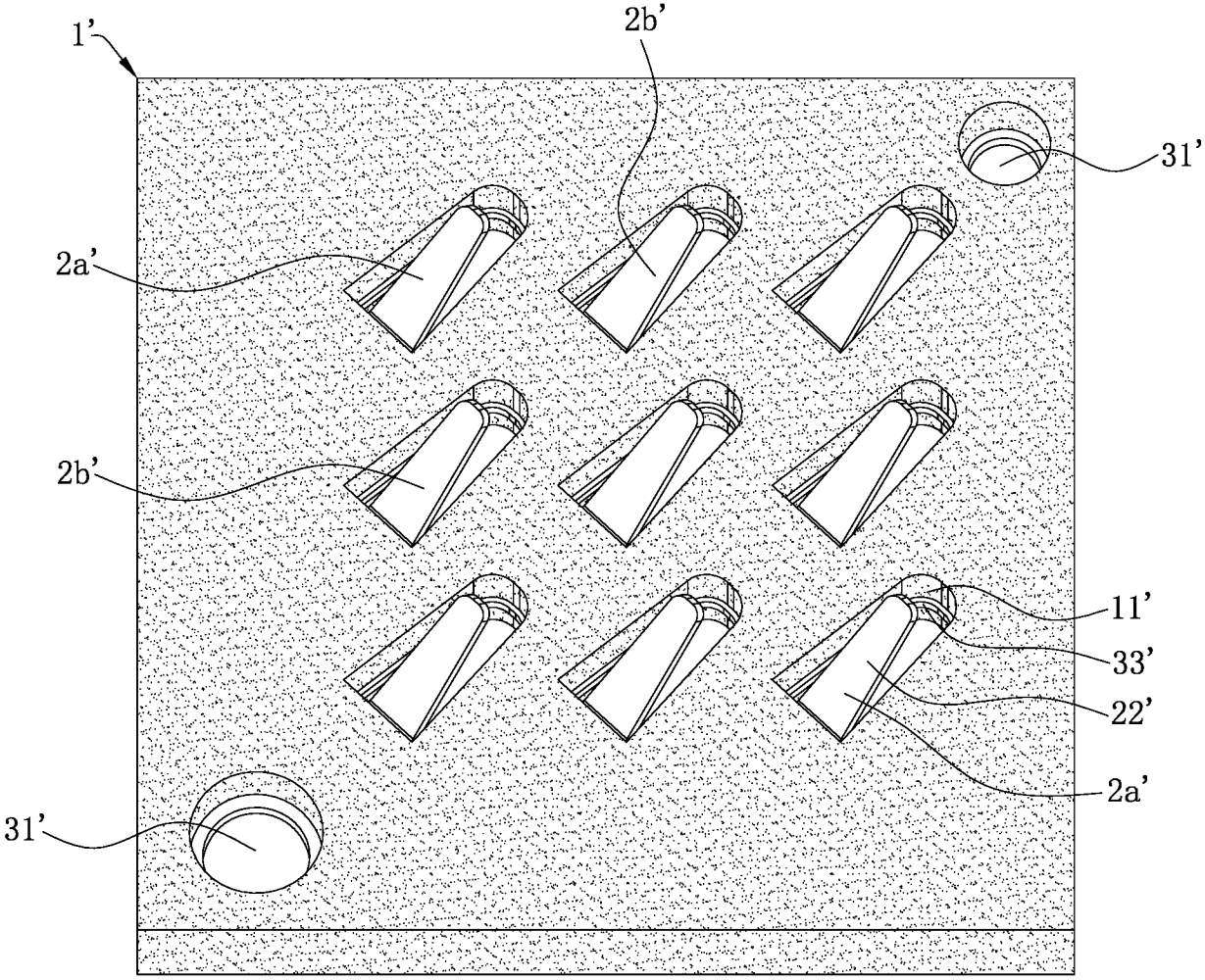
FIG. 7 is a perspective view of the electrical connector according to the first embodiment of the present invention after the elastic arm of each terminal bends upward.

FIG. 6 to FIG. 10 show a method for manufacturing an electrical connector according to a second embodiment of the present invention. The electrical connector includes an insulating body 1' and a plurality of terminals 2' accommodated in the insulating body 1'. The terminals 2' include a plurality of signal terminals 2*a'* and a plurality of ground terminals 2*b*'. Each terminal 2' has a base portion 21', used to be fixed to the insulating body 1'; and an elastic arm 22' formed by bending upward and extending from the base portion 21', used to upward elastically abut a mating component M'. The insulating body 1' is provided with a plurality of through holes 11' to respectively correspondingly expose the elastic arms 22' of the terminals 2'. A portion of a lower surface of the base portion 21' has a conducting area 210'. The conducting area 210' is exposed in the insulating body 1' and is used to be conductively connected to a circuit board N'. The method for manufacturing the electrical connector according to this embodiment includes the following steps:

Step 1: referring to FIG. 6, providing a metal plate 3', and cutting two positioning holes 31' at the opposite corners of the metal plate 3'. Each positioning hole 31' is circular. Providing a mold (not shown, same below). The mold is provided with a plurality of pairs of fixing posts (not shown, same below) and a plurality of pairs of positioning posts (not shown, same below). The positioning holes 31' match with the pairs of fixing posts of the mold for fixing the metal plate 3'. After fixing the metal plate 3' with the positioning holes 31', cutting the metal plate 3' through a laser according to a predetermined contour of the base portions 21' of the signal terminals 2*a*' and the ground terminal 2*b*' (when cutting the base portions 21' on the metal plate 3', the positioning holes 31' function to position the metal plate 3'). When cutting the base portion 21' of each signal terminal 2*a*', the three side edges of the base portion 21' of each signal terminal 2*a*' are cut and separated from the metal plate 3', thereby forming a U-shaped cutting slot 32' on the metal plate 3' surrounding the base portion 21'. However, when cutting the base portion 21' of each ground terminal 2*b*', the two opposite edges of the base portion 21' of each ground terminal 2*b*' are completely cut and separated from the metal plate 3', and the other side edge is partially cut, thereby forming two L-shaped cutting slots 32' opposite to each other surrounding the base portion 21', thereby forming a connecting portion 23' between the two cutting slots 32' connecting the base portion 21' of each ground terminal 2*b*' and the metal plate 3'.

Figure 8:
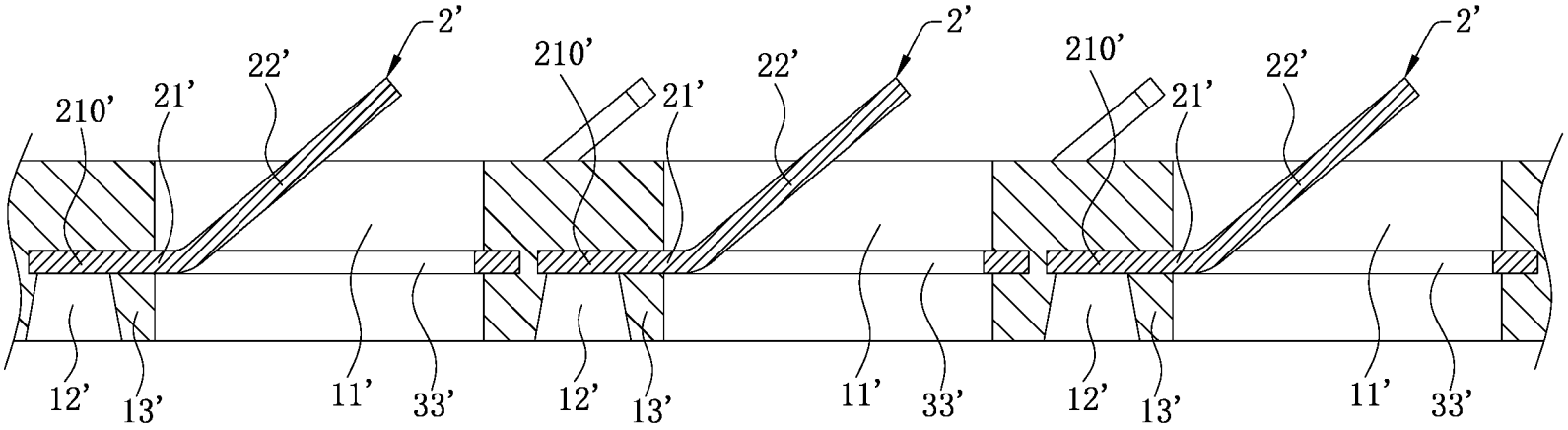
FIG. 8 is a sectional view of FIG. 7.
Figure 9:
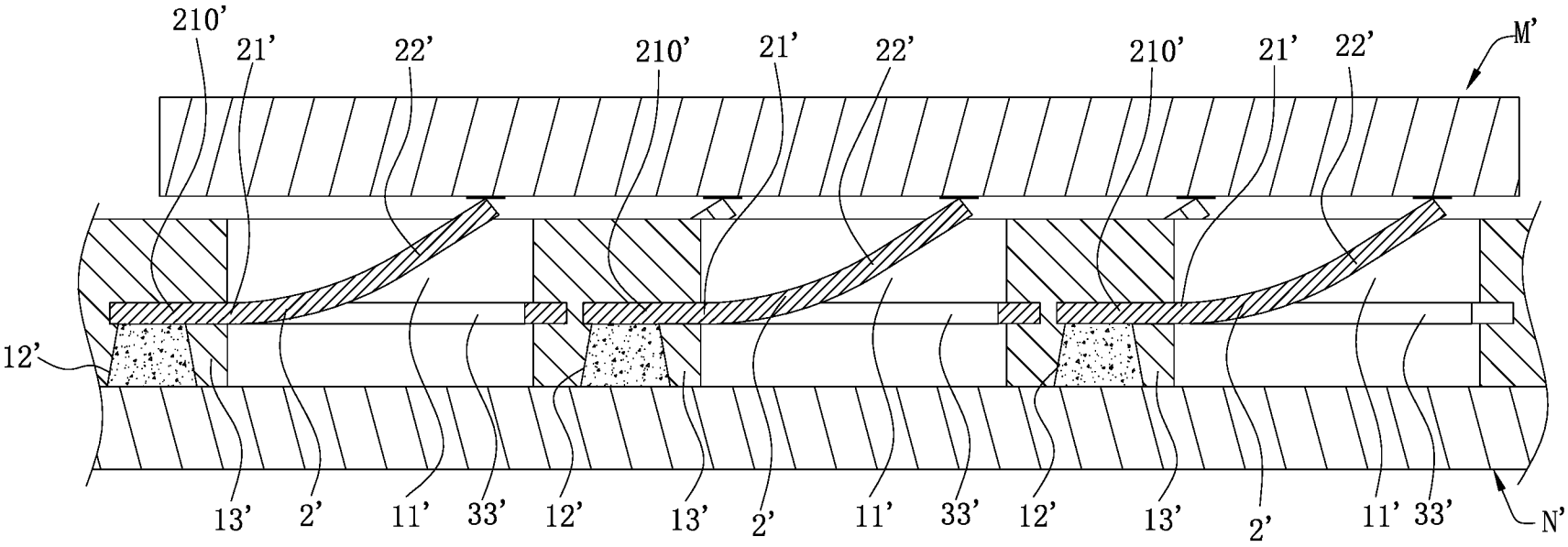
FIG. 9 is a sectional view of FIG. 8 being connected to the mating component and the circuit board.
Figure 10:
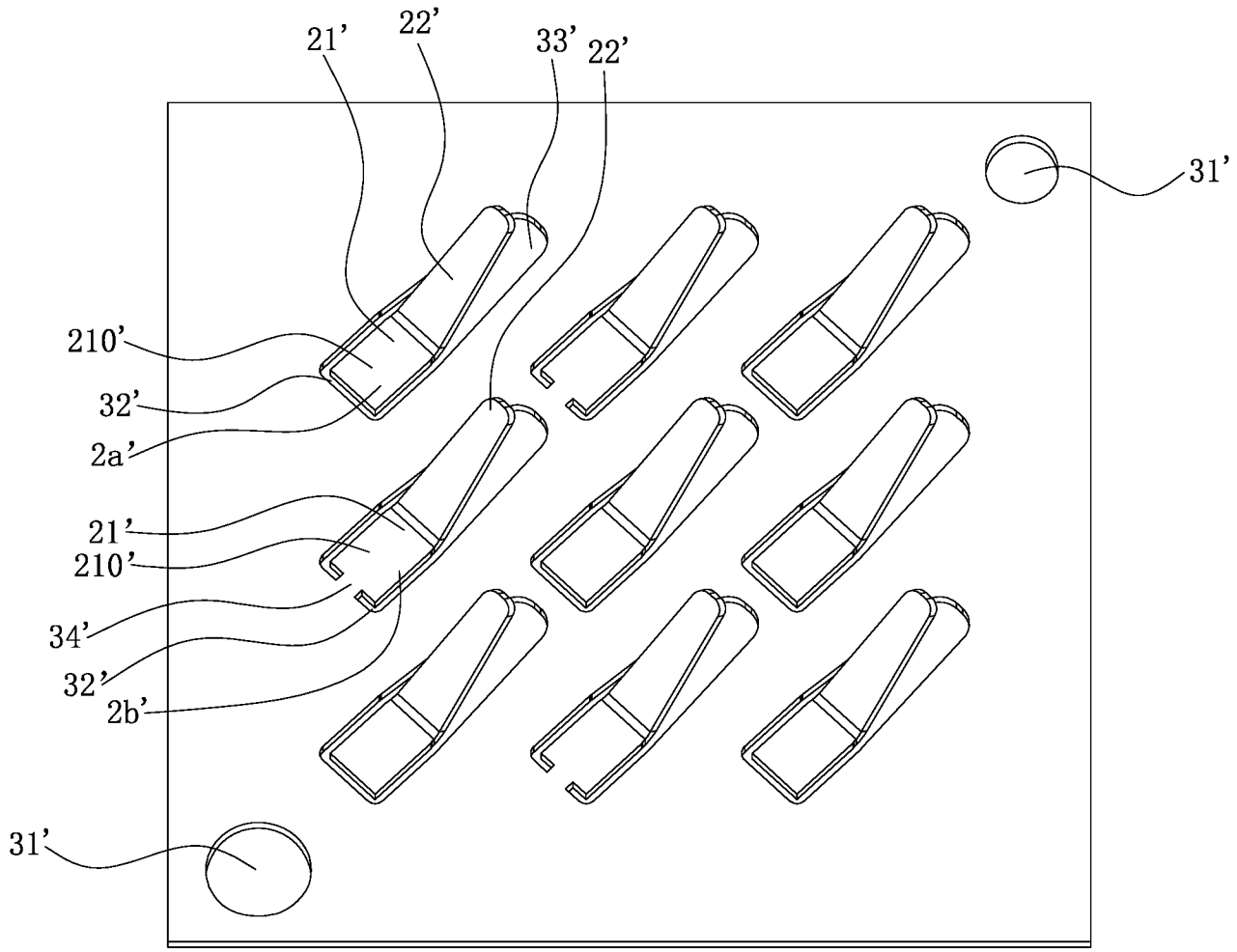
FIG. 10 is a perspective view of the metal plate in FIG. 7 after the manufacturing of the electrical connector is complete.

Step 2: referring to FIG. 6, a diameter of each positioning hole 31' is less than that of each fixing post. Each positioning hole 31' is clamped by a pair of the fixing posts vertically. Each elastic arm 22' is clamped by a pair of the positioning posts vertically. The length and width of each elastic arm 22' is less than those of each positioning post. The positioning posts, when clamping the elastic arm 22', also cover a portion of the cutting slot 32'. Then, the plastic material is injected to the metal plate 3', thereby forming the insulating body 1' on the metal plate 3'. The insulating body 1' covers the metal plate 3', and after removing the mold, the insulating body 1' forms the through holes 11'. Each elastic arm 22' is exposed in a corresponding through hole 11', and a length and a width of the corresponding through hole 11' is greater than a length and a width of each elastic arm 22'. A portion of the cutting slot 32' is exposed in the corresponding through hole 11'. Referring to FIG. 8, after the injection molding, the insulating body 1' is formed with an accommodating slot 12' and a stopping block 13'. The conducting area 210' is higher than a bottom end of the accommodating slot 12', and the accommodating slot 12' gradually becomes smaller along an upward direction from a bottom thereof, such that the solder may better enter the accommodating slot 12', thereby implementing soldering of the conducting area 210' and the circuit board N'. The stopping block 13' is located between the accommodating slot 12' and the through hole 11', such that the accommodating slot 12' and the through hole 11' are not in communication, effectively preventing the solder accommodated in the accommodating slot 12' from entering the through hole 11' to be in contact with the elastic arm 22' and affecting the electrical connection between the elastic arm 22' and the mating component M'.

Step 3: referring to FIG. 6, through the laser, cutting each elastic arm 22' exposed out of the insulating body 1' along a location separated from an edge of the corresponding through hole 11'. After cutting, the side edge of each elastic arm 22' forms a through slot 33' surrounding the elastic arm 22'. The edge of the corresponding through hole 11' is separated from the through slot 33', thus preventing from burning the edge of the corresponding through hole 11' in the laser cutting process due to the excessively high temperature of the laser. During the laser cutting, the cutting slot 32' and the through slot 33' are in communication, such that each signal terminal 2*a*' is independent from the metal plate 3'. After cutting the elastic arm 22', electroplating the metal plate 3', and then bending the elastic arm 22' upward, such that the elastic arm 22' protrudes upward out of the insulating body 1'.

In sum, the method for manufacturing the electrical connector according to certain embodiments of the present invention has the following beneficial effects:

1. By firstly injection molding the insulating body and the metal plate, and then cutting the elastic arm on the metal plate, the through slot is formed after the injection molding, thereby not causing the plastic material to enter the through slot and fix the elastic arm, ensuring the elastic characteristics of the elastic arm, and preventing from the ill contact between the elastic arm and the mating component. Further, since there is no molten plastic overflow, the positioning posts of the mold do not need to pass beyond the through slot with a greater distance along the horizontal direction, thereby reducing the pitch between the terminals, which is conducive to the dense arrangement of the terminals.

2. The insulating body is provided with a stopping block located between the accommodating slot and the through hole, such that the through slot and the cutting slot are not in communication, effectively preventing the solder accommodated in the accommodating slot from entering the through hole to be in contact with the elastic arm and affecting the electrical connection between the elastic arm and the mating component.

3. During the injection molding in the step 2, the insulating body does not fill at least one outer edge of the metal plate, such that the at least one outer edge of the metal plate is exposed by the insulating body. Further, the insulating body does not fill the positioning holes, such that the portions of the metal plate surrounding the positioning holes are exposed in the insulating body, thereby allowing the metal plate to be injection molded and then electroplated conveniently.

4. The cutting slot is partially exposed in the through hole, such that when the connecting portion of each signal terminal is cut, it is ensured that the connecting portion of each signal terminal is cut cleanly, preventing the signal terminals from being indirectly connected together and short-circuiting due to the connecting portion of each signal terminal not being cut cleanly.

5. After cutting the connecting portion of each signal terminal, the elastic arm bends upward, which is conducive to laser focusing in the cutting process, such that the cutting location is more accurate, enhancing the accuracy of the forming of the terminals.

6. When the elastic arm is cut in the step 3, the elastic arm is cut along a location separated from an edge of the through hole, and after cutting, a through slot is formed at a side edge of the elastic arm. The edge of the through hole and the through slot are separated, thus preventing from burning the edge of the through hole in the laser cutting process due to the excessively high temperature of the laser.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A method for manufacturing an electrical connector, comprising:

providing a metal plate in a flat plate shape, wherein the metal plate defines a plurality of terminals in a selected area, each of the terminals has a base portion and an elastic arm connected to the base portion, the elastic arm is configured to be in contact with a mating component, and a portion of a lower surface of the base portion defines a conducting area configured to be conductively connected to a circuit board; and cutting the base portion on the metal plate according to a predetermined contour of the base portion, thereby forming a cutting slot on the metal plate located at a side edge of the base portion;

after cutting the base portion, forming an insulating body on the metal plate by injection molding, such that the insulating body fills the cutting slot, wherein the insulating body covers the base portion but does not cover the conducting area, and the insulating body does not cover the elastic arm, thereby forming a through hole on the insulating body to expose the elastic arm; and after forming the insulating body, cutting the elastic arm on the metal plate according to a predetermined contour of the elastic arm, thereby forming a through slot on the metal plate surrounding the elastic arm.

2. The method according to claim 1, wherein the insulating body forms an accommodating slot to expose the conducting area, a lower end of the accommodating slot is lower than the conducting area, along an upward direction from a bottom thereof, the accommodating slot gradually becomes smaller, and the insulating body is provided with a stopping block located between the accommodating slot and the through hole, such that the accommodating slot and the through hole are not in communication.

3. The method according to claim 1, further comprising: prior to forming the insulating body, forming a plurality of positioning holes on the metal plate, wherein after forming the insulating body, the insulating body does not fill the positioning holes, such that portions of the metal plate surrounding the positioning holes are exposed by the insulating body.

4. The method according to claim 1, wherein after forming the insulating body, the insulating body does not cover at least one outer edge of the metal plate, such that the at least one outer edge of the metal plate is exposed by the insulating body.

5. The method according to claim 1, wherein after forming the insulating body, the cutting slot is partially exposed in the through hole.

6. The method according to claim 1, further comprising: after cutting the base portion and prior to forming the insulating body, bending the conducting area downward.

7. The method according to claim 1, wherein the terminals comprise a plurality of signal terminals and a plurality of ground terminals, and after cutting the elastic arm, each of the ground terminals forms a connecting portion between the corresponding through slot and the cutting slot, wherein the connecting portion is connected to the elastic arm.

8. The method according to claim 7, wherein after cutting the elastic arm, a connecting portion of each of the terminals is formed between the corresponding through slot and the cutting slot and is connected to the elastic arm of each of the terminals, and after cutting the elastic arm, the connecting portion of each of the signal terminals is removed, and the connecting portion of each of the ground terminals is reserved.

9. The method according to claim 8, further comprising: after removing the connecting portion of each of the signal terminals, bending the elastic arm of each of the terminals upward, such that the elastic arm protrudes out of the insulating body.

10. The method according to claim 8, further comprising: after cutting the elastic arm and prior to removing the connecting portion of each of the signal terminals, electroplating the metal plate.

11. The method according to claim 1, wherein after cutting the elastic arm, the elastic arm is cut along a location spaced apart from an edge of the through hole by a distance, thereby staggering the edge of the through hole and the through slot.

* * * * *